US008307744B2

(12) United States Patent
Lanfear et al.

(10) Patent No.: US 8,307,744 B2
(45) Date of Patent: Nov. 13, 2012

(54) MODIFIED REACTION ARM TOOL AND TOOL KIT

(75) Inventors: Harold Jay Lanfear, Murfreesboro, TN (US); Mark D. Pionke, Mount Juliet, TN (US)

(73) Assignee: Nissan North America, Inc., Franklin, TN (US)

( * ) Notice: Subject to any disclaimer, the term of this patent is extended or adjusted under 35 U.S.C. 154(b) by 386 days.

(21) Appl. No.: 12/731,529

(22) Filed: Mar. 25, 2010

(65) Prior Publication Data

US 2011/0232428 A1 Sep. 29, 2011

(51) Int. Cl.
*B25B 23/00* (2006.01)

(52) U.S. Cl. ..... 81/462; 81/185.2; 81/13

(58) Field of Classification Search ..... 81/462, 81/180.1, 185.2, 184, 176.1–176.3, 13, 55
See application file for complete search history.

(56) References Cited

U.S. PATENT DOCUMENTS

| | | | | | |
|---|---|---|---|---|---|
| 300,968 | A * | 6/1884 | Hatfield | 81/13 |
| 542,922 | A * | 7/1895 | Brock | 81/176.2 |
| 1,006,348 | A * | 10/1911 | Beran | 81/176.3 |
| 1,425,845 | A * | 8/1922 | Foster | 81/176.15 |
| 1,914,827 | A * | 6/1933 | Hammerich | 81/13 |
| 2,444,371 | A * | 6/1948 | Riccio | 81/176.3 |
| 2,766,649 | A * | 10/1956 | Labry, Jr. | 81/185.1 |
| 4,104,936 | A * | 8/1978 | Sjostrom | 81/180.1 |
| 5,033,501 | A | 7/1991 | Stehling | |
| 6,640,670 | B2 * | 11/2003 | Belcher | 81/13 |
| 6,745,648 | B2 | 6/2004 | Stier | |
| 6,912,936 | B2 * | 7/2005 | Hume | 81/13 |
| 6,978,703 | B2 * | 12/2005 | Whitehead et al. | 81/176.3 |
| 2009/0013834 | A1 * | 1/2009 | Richardson | 81/180.1 |

OTHER PUBLICATIONS

NETA, Seacoast Trials Club, East Coast Hoppers, Image of motorcycle with Y-shaped tool bolted on face of flywheel, Oct. 13, 2009.

* cited by examiner

*Primary Examiner* — Hadi Shakeri
(74) *Attorney, Agent, or Firm* — Young, Basile, Hanlon & MacFarlane, P.C.

(57) ABSTRACT

Disclosed herein are embodiments of tools and tool kits for use with a movable work piece having at least one fastener, the tool preventing movement of the work piece and fastener when a force is exerted on the fastener. One embodiment of such a tool comprises an elongate handle, a first arm and a second arm. The first arm has a distal end with an aperture configured to engage the fastener to prevent the fastener from rotating when a rotational force is exerted on the fastener. The first arm is movably connected to the elongate handle. The second arm extends from the elongate handle. The second arm is spaced apart from the first arm and comprises a side surface configured to contact a portion of the movable work piece to prevent the work piece from movement. The first arm is movably connected to the handle proximate the second arm.

13 Claims, 6 Drawing Sheets

MODIFIED REACTION ARM TOOL AND TOOL KIT

FIELD OF THE INVENTION

The present invention relates in general to a tool and a tool kit for holding stationary both a work piece and a fastener when a rotational force is exerted on the fastener.

BACKGROUND

Work pieces often have fasteners such as nuts and bolts that need to be tightened or loosened by rotating the bolt while holding the nut, for example. If the work piece is stationary, one person can use a type of wrench to hold the nut stationary while using another tool to rotate the bolt. However, if the work piece is of such a weight, size or shape that it will move during the process of rotating the bolt, a second person is necessary to hold the work piece either manually or with a third tool so prevent movement of the work piece during the rotation of the bolt. This is also a problem during manufacturing when the torque of fasteners must be verified to meet design specifications. For example, a rear drive shaft is secured to a rear axle with nuts and bolts. A technician will use a torque checking tool on the bolt head and a wrench on the corresponding nut and pull each tool in an opposite direction. However, do to the shape of the shaft and the alignment of the bolts, the shaft moves during this process and affects the torque reading.

SUMMARY

Disclosed herein are embodiments of tools and tool kits for use with a movable work piece having at least one fastener, the tool preventing movement of the work piece and fastener when a force is exerted on the fastener. One embodiment of such a tool comprises an elongate handle, a first arm and a second arm. The first arm has a distal end with an aperture configured to engage the fastener to prevent the fastener from rotating when a rotational force is exerted on the fastener. The first arm is movably connected to the elongate handle. The second arm extends from the elongate handle. The second arm is spaced apart from the first arm and comprises a side surface configured to contact a portion of the movable work piece to prevent the work piece from movement. The first arm is movably connected to the handle proximate the second arm.

Another embodiment of a tool used to prevent movement during loosening, tightening, or testing of a fastener is disclosed herein. The tool comprises an elongated main portion having a handle end configured to be gripped by a user and a work piece end configured to contact a portion of the work piece. A first arm has a distal end with an aperture configured to engage the fastener. The first arm is movably connected to the elongated main portion at a location closer to the work piece end. The fastener has a first axis about which it rotates and the movable work piece has a second axis about which it rotates parallel to the first axis. The first arm is configured to prevent rotation of the fastener about the first axis while the work piece end of the elongated main portion prevents rotation of the work piece about the second axis when a force is exerted on the handle.

Also disclosed are embodiments of tool kits for use with movable work pieces having at least one fastener. One embodiment of a tool kit comprises an elongated main portion having a handle end and a work piece end; a plurality of first arms, each having a distal end with an aperture, each aperture configured to engage a different size or shape fastener; and one or more shoe portions. Each of the one or more shoe portions have a surface contoured to grip a different size or shape work piece. The one or more shoe portions are interchangeably connectible to the work piece end of the elongated main portion. Each of the plurality of first arms is interchangeably connectible to the elongated main portion at a location nearer the work piece end, such that when the aperture engages the fastener, the surface of the shoe portion is in contact with a surface of the work piece.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
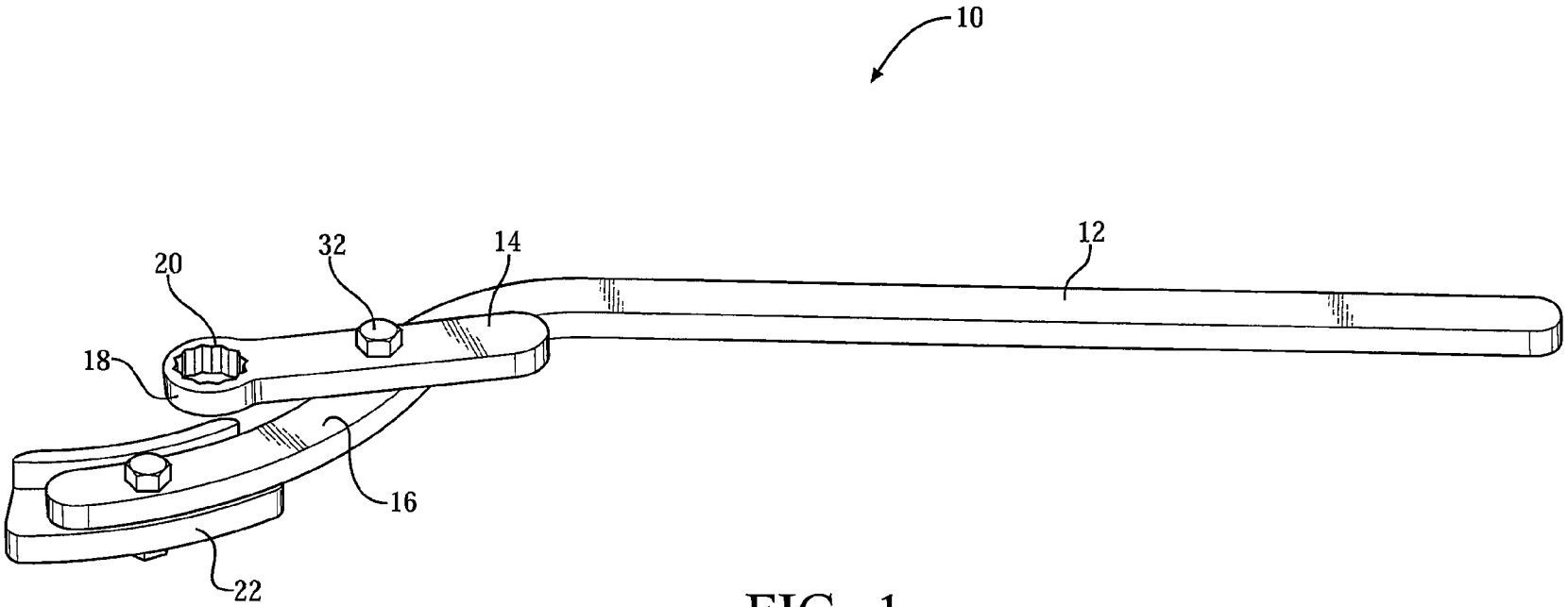
FIG. 1 is a perspective view of an embodiment of a tool disclosed herein.
Figure 2:
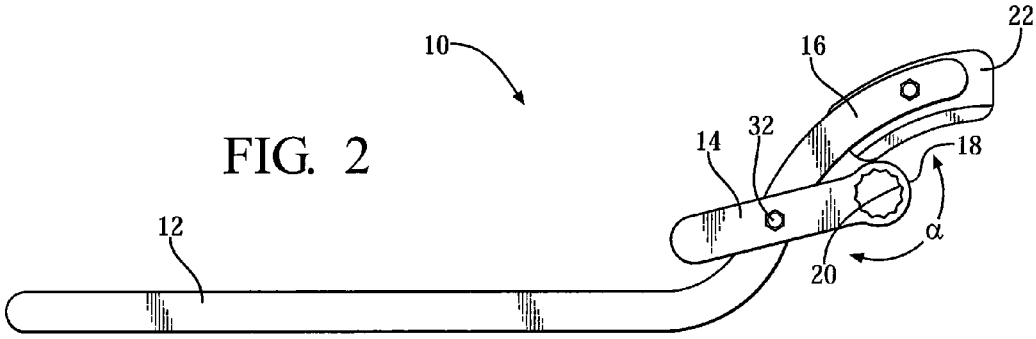
FIG. 2 is a plan view of the embodiment of the tool of FIG. 1.
Figure 3:
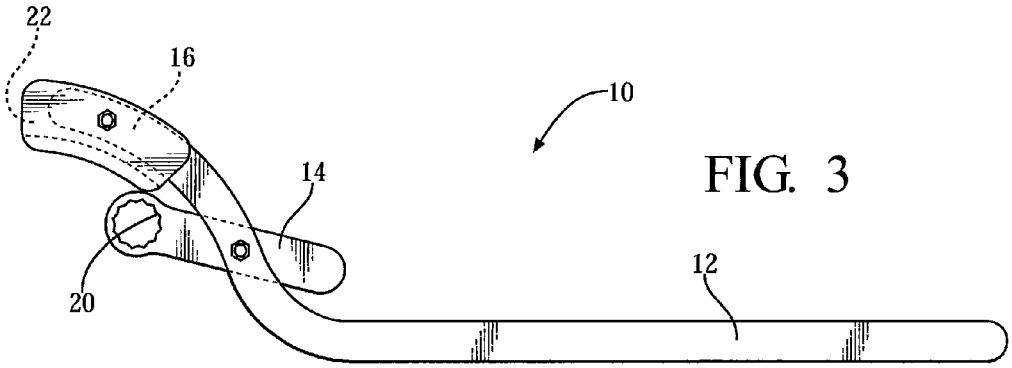
FIG. 3 is a plan view from the other side of the tool of FIG. 1.

FIGS. 1-3 illustrate an embodiment of a tool for use with a movable work piece having at least one fastener. The tool 10 has an elongate handle 12, a first arm 14 and a second arm 16. The first arm 14 has a distal end 18 with an aperture 20 configured to engage a fastener. The first 14 arm is movably connected to the elongate handle 12. The second arm 16 extends from the elongate handle 12. The second arm 16 is spaced apart from the first arm 14 and has a shoe portion 22 movably connected to and at least partially covering a free end portion of the second arm 16, the shoe portion 22 having a surface configured to grip the work piece. The first arm 14 is movably connected to the handle 12 closer to the second arm 16.

Figure 4:
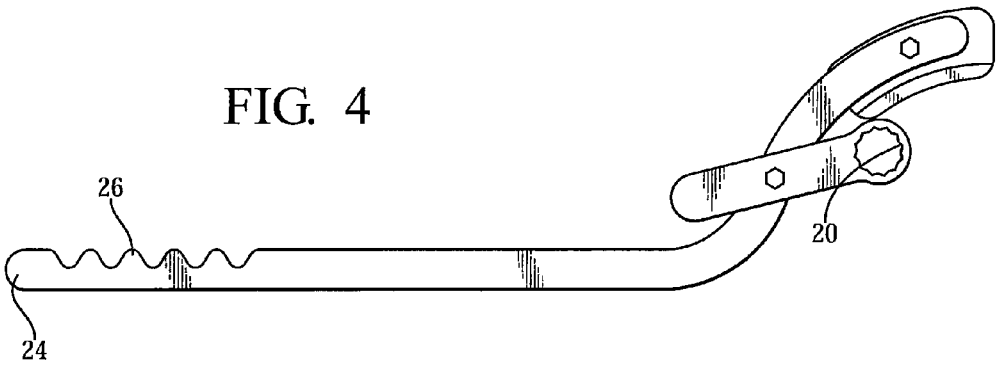
FIG. 4 is a plan view of another embodiment of the tool disclosed herein.
Figure 5:
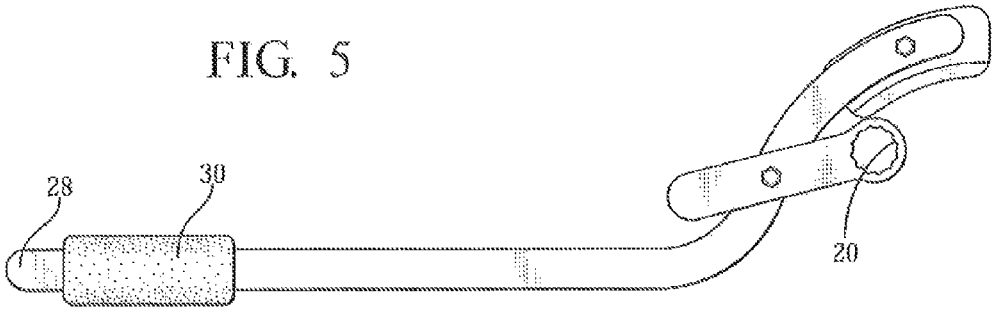
FIG. 5 is a plan view of another embodiment of the tool disclosed herein.

The elongate handle 12 can have a contoured gripping end 24, as shown in FIG. 4. The contour 26 can be, as a non-limiting example, formed to fit the fingers of a user. The elongate handle 12 can have a padded gripping end 28, as shown in FIG. 5. The grip 30 can be of any size that provides comfort to the user while enabling the user to grasp the handle with a single hand. The grip 30 can be made of any material suitable. For example, the grip 30 may be rubber or a flexible polymer. The elongate handle 12 can be any length desired or required by a particular work piece or work station, but should be of a length sufficient that allows for a user to grasp the handle and exert force on the handle.

The length of the first and second arms 14, 16 will be dictated by the work piece on which it will be used. The handle 12 and the second arm 16 are connected in a fixed relationship. It is contemplated that the elongated handle 12 and the second arm 16 are a single component, with the second arm 16 being an end portion of the handle 12 opposite the grip. The second arm 16 extends from the elongated handle 12 at an angle α, shown in FIG. 2. The degree of the angle α is dependent on the size and shape of the work piece. The angle α is typically less than ninety degrees.

The first arm 14 is movably connected to the elongate handle 12, with a coupling 32, one example being a locking nut and bolt type fastener, as illustrated. The locking nut and bolt are provided by way of example and are not intended to be limiting. Any type connector or coupling that allows for rotational movement between the pieces can be used. For example, bushings, steel sleeves, crown nuts, rivets, pins, etc. can be used.

The first arm 14 of the tool is designed to hold the fastener in a stationary position. The aperture 20 in the distal end 18 of the first arm 14 can be any shape desired or required to fit the fastener used. For example, the aperture 20 can be round, square, 6 point hexagonal, 12 point hexagonal, octagonal, etc. The aperture 20 in the distal end 18 of the first arm 14 can be any size desired or required to fit the fastener used. For example, the aperture 20 can be a quarter inch diameter, three-eighths inch, a half inch, three-quarters inch, etc.

Figure 6:
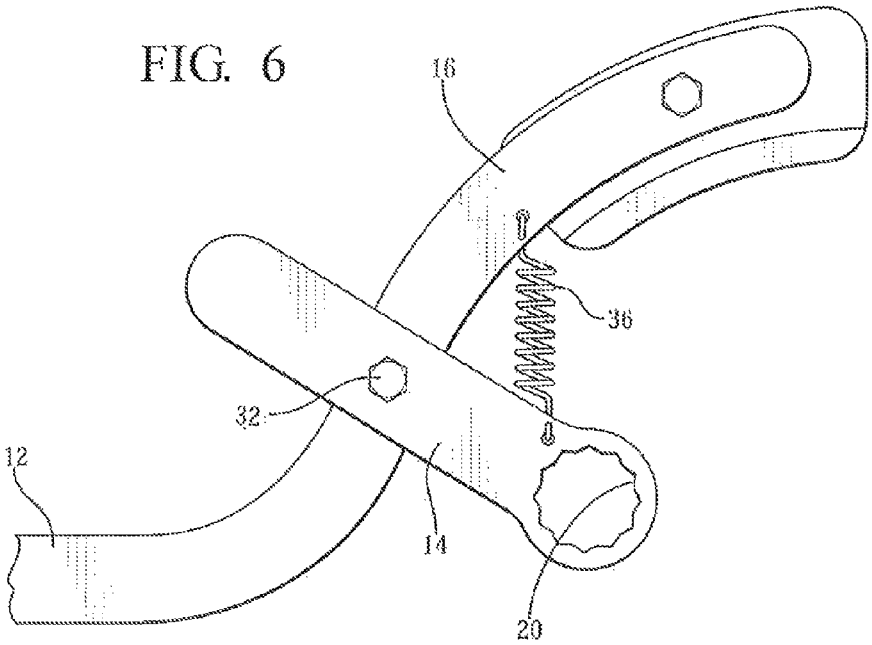
FIG. 6 is an enlarged view of a portion of a tool disclosed herein.

The spaced distance between the first arm 14 and second arm 16 is also dependent on the shape and size of the work piece and the relationship of the fastener to the work piece. Because the first arm 14 is movably connected to the handle 12, a means for biasing the first arm 14 toward the second arm 16 can be included. As shown in FIG. 6, a spring 36 can be positioned between the first and second arms 14, 16 to keep the first arm 14 from rotating freely around its coupling 32. The spring 36 is used by means of example and is not meant to be limiting. Other biasing means can be used, such as an elastic material, a band around the two arms, a stopper on the first or second arm 14, 16 that prevents full rotation of the first arm 14, etc.

The shoe portion 22 on the second arm 16 is designed to grip the work piece. It is contemplated that the shoe portion can be a side surface of the second arm 16 itself.

Figure 7:
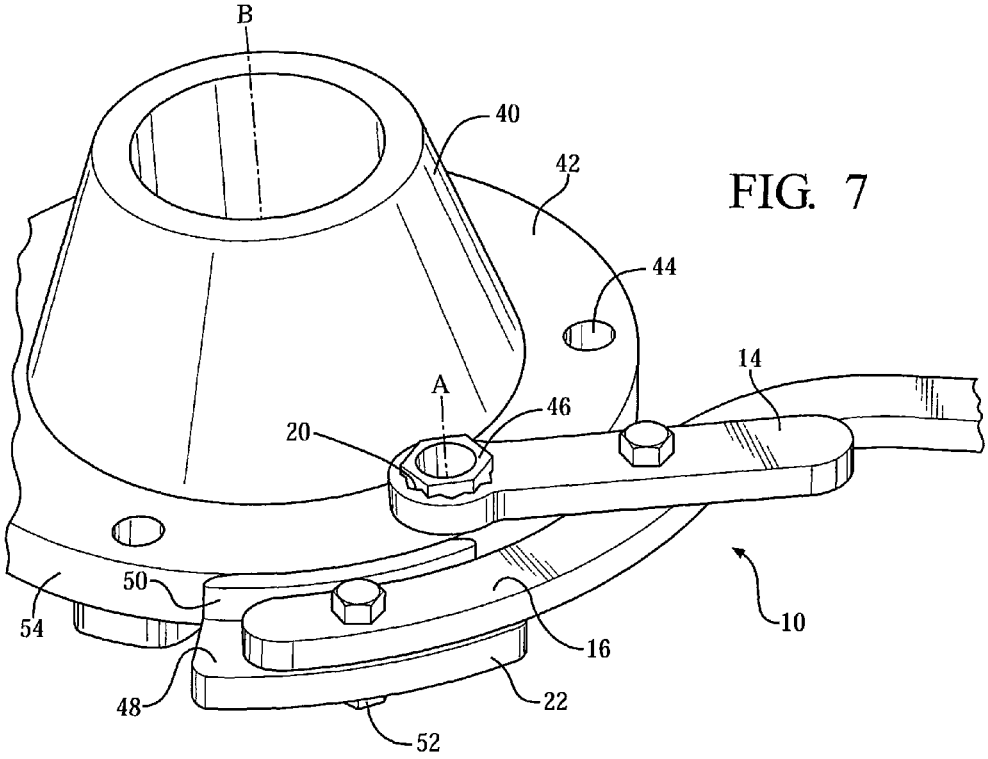
FIG. 7 is a perspective view of the tool of FIG. 1 with a work piece.
Figure 8:
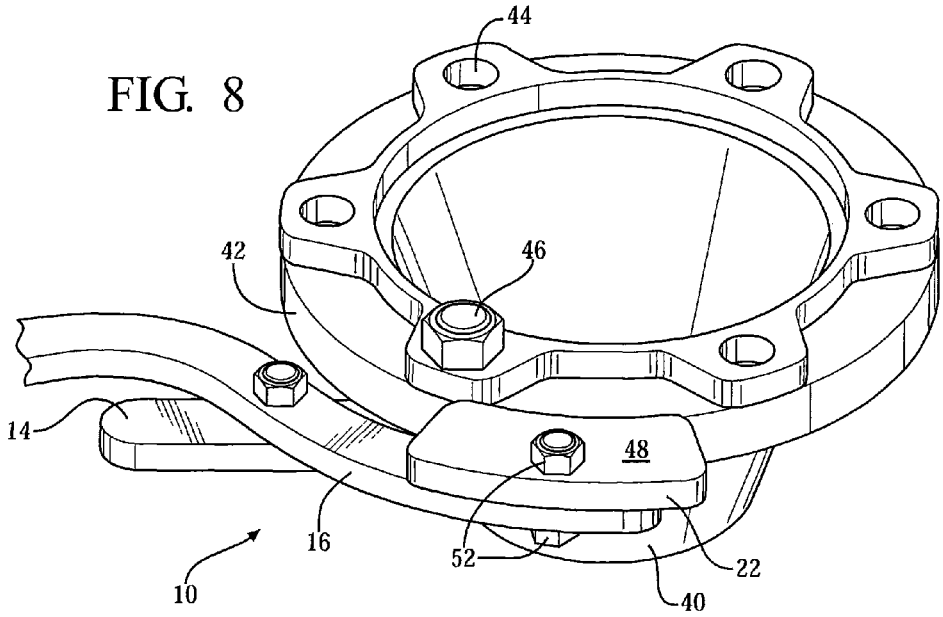
FIG. 8 is a perspective view of the tool and work piece of FIG. 7 from the other side.
Figure 9:
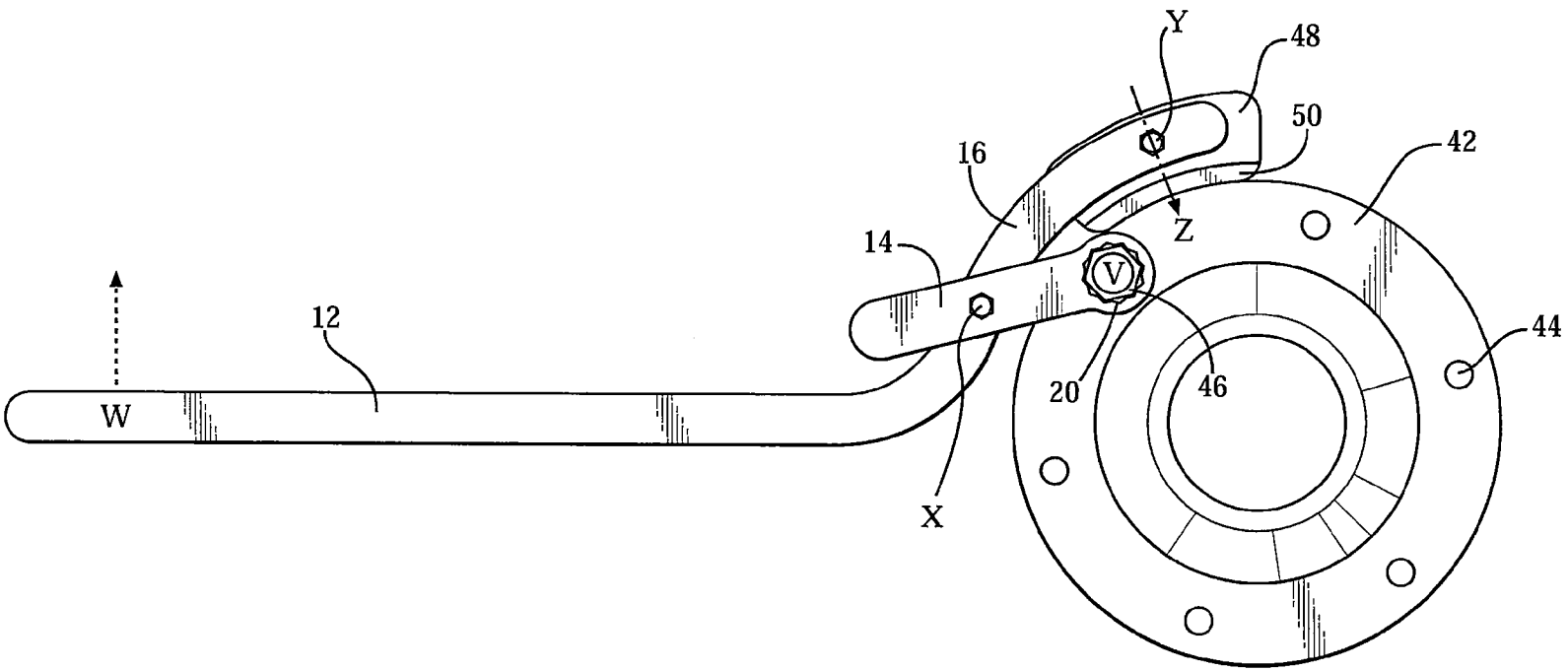
FIG. 9 is a plan view of the tool and work piece of FIG. 7.

FIGS. 7-9 show the tool 10 in use on a work piece 40. The work piece 40 can be any movable work piece. To illustrate the use of the tool 10, a cylindrical work piece 40 is used having a flange 42 with openings 44 through which fasteners 46 are inserted. A non-limiting example of a work piece 40 is a vehicle drive shaft connected to an axle. The fasteners 46 can be, for example, a nut and bolt combination. However, the tool 10 can be used with any fastener 46 that has two rotating components.

As seen in FIGS. 7-9, the aperture 20 of the first arm 14 of the tool 10 is sized to just fit over the fastener 46 so that the fastener 46 cannot rotate within the aperture 20. The first arm 14 is free to move with respect to the second arm 16 so that it can be adjusted to align with the fastener 46. The second arm 16 then is pressed against the work piece 40 so that the shoe portion 22 grips the work piece 40. The shoe portion 22 can have a main portion 48 movably connected to the second arm 16 on a side opposite the first arm 14, and a side surface 50 extending in an L-shape from an edge of the main portion 48, the side surface 50 conforming to a shape of a surface of the work piece 40.

The shoe portion 22 is movably connected to the second arm 16, for example, with a locking nut and bolt type fastener 52, as illustrated. The locking nut and bolt are provided by way of example and are not intended to be limiting. Any type connector or coupling that allows for rotational movement between the pieces can be used. For example, bushings, steel sleeves, crown nuts, rivets, pins, etc. can be used. Although the shoe portion 22 does not have to move as much as the first arm 14, some movement is desirable to allow for slight changes from work piece to work piece.

As seen in FIGS. 7-9, the side surface 50 of the shoe portion 22 is contoured to uniformly contact the outer surface 54 of the work piece 40, here the flange 42. The area of the side surface 50 of the shoe portion 22 can be of varying widths and lengths, depending on the work piece 40. The shoe portion 22 can be made out of, in part or in whole, a flexible material such as rubber to prevent slippage. The shoe portion 22 can be partially or fully coated with a flexible material such as rubber. The side surface 50 of the shoe portion 22 can have an uneven or roughened surface to improve the grip on the work piece 40.

The fastener 46 has a first axis A about which it rotates and the movable work piece 40 has a second axis B about which it rotates, as shown in FIG. 7. In use, the first arm 14 is configured to prevent rotation of the fastener 46 about the first axis A when a rotational force is being asserted on an opposite end of the fastener 46, while the second arm 16 prevents rotation of the work piece 40 about the second axis B with exertion of force on the elongate handle 12.

Referring to FIG. 9, and using a nut and bolt as an example of the fastener 46, the aperture 20 of the first arm 14 is fitted over the nut at point V. With the shoe portion 22 of the second arm 16 contacting the work piece 40, the first arm becomes rigid. As a force is applied to the handle 12 around point W, the tool 10 will rotate about point X, causing the second arm 16 to move toward the surface of the work piece 40. The force from point Y to point Z holds the work piece stationary while the first arm 14 is holding the nut stationary. A torque can be applied to the bolt on the opposite side to loosen the bolt, tighten the bolt, or test the bolt. Because the work piece 40 and the nut are held stationary during the torque test, the reading will be accurate and will not require a second person to hold the work piece. Alternatively, the aperture 20 of the first arm 14 can be fitted over the bolt head at point V. A torque can be applied to the nut on the opposite side to loosen, tighten, or test the nut.

Figure 10:
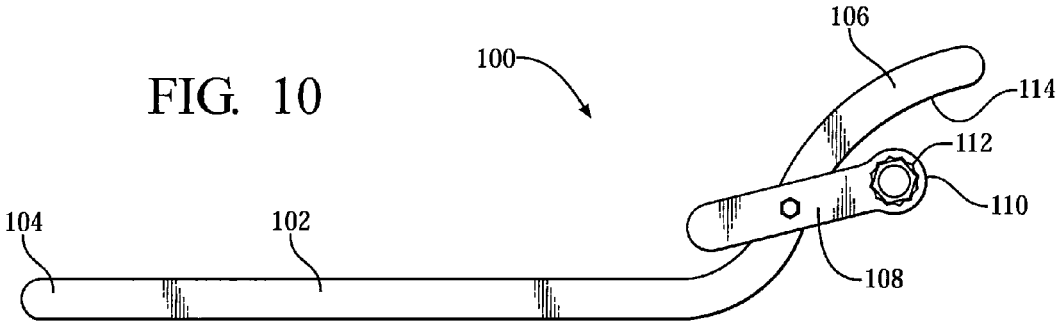
FIG. 10 is a plan view of another embodiment of a tool disclosed herein.

Another embodiment of a tool for use with a movable work piece having at least one fastener is illustrated in FIG. 10. The tool 100 comprises an elongated main portion 102 having a handle end 104 configured to be gripped by a user and a work piece end 106 configured to contact a portion of the work piece. A first arm 108 has a distal end 110 with an aperture 112 configured to engage the fastener. The first arm 108 is movably connected to the elongated main portion 102 at a location closer to the work piece end 106. As shown in FIG. 7, the fastener 46 has a first axis A about which it rotates and the movable work piece 40 has a second axis B about which it rotates. The second axis B is parallel to the first axis A. The first arm 108 is configured to prevent rotation of the fastener 46 about the first axis A while the work piece end 106 of the elongated main portion 102 prevents rotation of the work piece 40 about the second axis B when a force is exerted on the handle end 104.

The side surface 114 of the work piece end 106 can be roughened to prevent slippage or can be covered with or partially made from a flexible material such as rubber. Alternatively, the shoe portions described with respect to the first embodiment can be employed.

The handle end 104 of the elongated main portion 102 can have a contoured gripping end, as discussed with respect to FIG. 4. The handle end 104 can have a padded gripping end, as discussed with respect to FIG. 5. The elongated main portion 102 can be any length desired or required by a particular work piece or work station, but should be of a length sufficient that allows for a user to grasp the handle and exert force on the handle.

The work piece end 106 of the main portion 102 can extend from the elongated main portion 102 at an angle α, as shown in FIG. 2. The degree of the angle α is dependent on the size and shape of the work piece. The angle α is typically less than ninety degrees.

The first arm 108 is movably connected to the elongated main portion 102, for example, with a locking nut and bolt type fastener. The locking nut and bolt are provided by way of example and are not intended to be limiting. Any type connector or coupling that allows for rotational movement between the pieces can be used. For example, bushings, steel sleeves, crown nuts, rivets, pins, etc. can be used.

As shown in FIG. 6, a spring 36 can be positioned between the first arm 108 and the work piece end 106 to keep the first arm 108 from rotating freely around its coupling. The spring 36 is used by means of example and is not meant to be limiting. Other biasing means can be used, such as an elastic material, a band around the two arms, a stopper that prevents full rotation of the first arm 108, etc.

Figure 11:
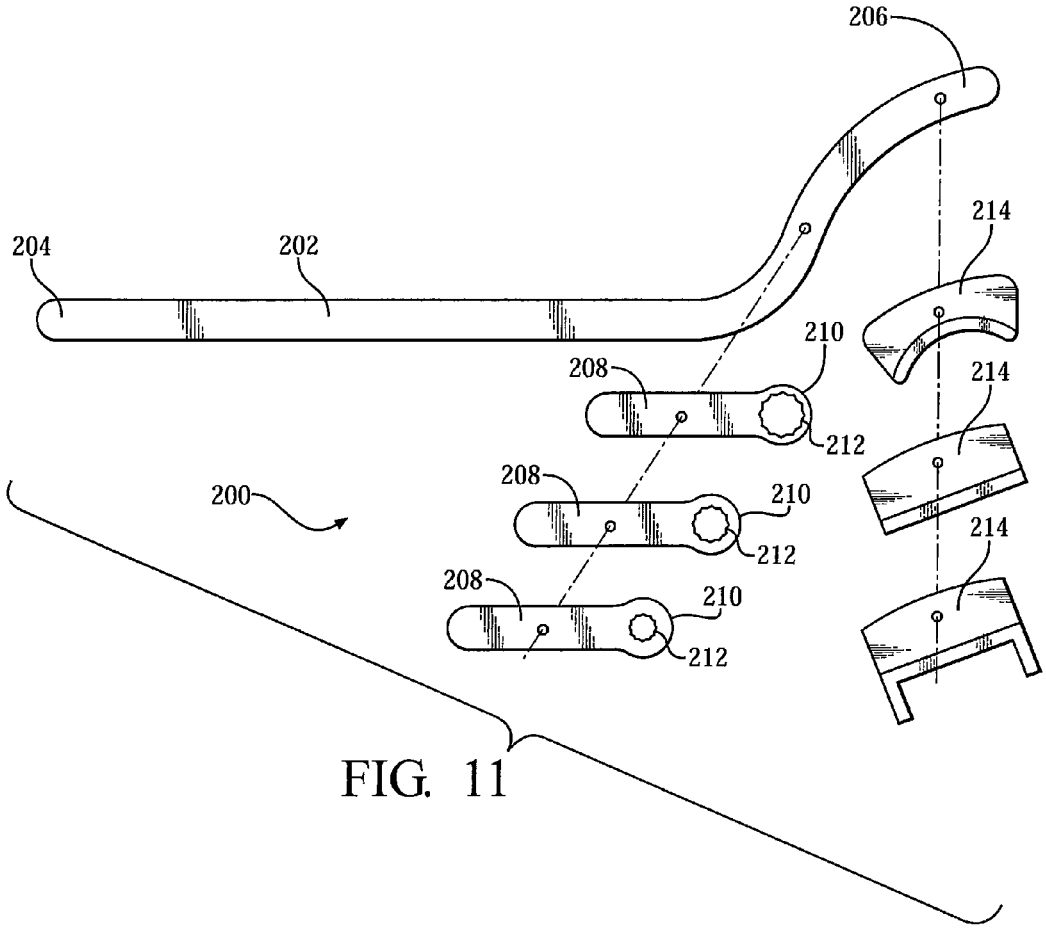
FIG. 11 is plan view of an embodiment of a tool kit disclosed herein.

Also disclosed herein are tool kits for use with a moveable work pieces and different fasteners. One embodiment of a tool kit 200 is shown in FIG. 11 and comprises an elongated main portion 202 having a handle end 204 and a work piece end 206. The tool kit 200 also has a plurality of first arms 208, each having a distal end 210 with an aperture 212, each aperture 212 configured to engage a different size or shape fastener. For example, the tool may come with four interchangeable first arms, including one of each sized aperture: quarter inch diameter, three-eighths inch, a half inch and three-quarters inch.

The elongated main portion 202 can come with a shoe portion as described elsewhere herein. Alternatively, the tool kit 200 can include one or more interchangeable shoe portions 214, each of the one or more shoe portions 214 having a surface 216 contoured to grip a different size or shape work piece. The one or more shoe portions 214 are interchangeably connectible to the work piece end 206 of the elongated main portion 202.

The shoe portions 214 can be made out of, in part or in whole, a flexible material such as rubber to prevent slippage. The shoe portions 214 can be partially or fully coated with a flexible material such as rubber. A side surface of the shoe portions 214 can have an uneven or roughened surface to improve the grip on the work piece.

The handle end 204 of the elongated main portion 202 can have a contoured gripping end, as discussed with respect to FIG. 4. The handle end 204 can have a padded gripping end, as discussed with respect to FIG. 5. The elongated main portion 202 can be any length desired or required by a particular work piece or work station, but should be of a length sufficient that allows for a user to grasp the handle and exert force on the handle.

The work piece end 206 of the main portion 202 can extend from the elongated main portion 202 at an angle α, as shown in FIG. 2. The degree of the angle α is dependent on the size and shape of the work piece. The angle α is typically less than ninety degrees.

A spring such as that shown in FIG. 6 can be connected to the work piece end 206 of the main portion 202 such that when one of the first arms 208 is attached, the spring can be attached to the first arm 208 to keep the first arm 208 from rotating freely around its coupling. The spring is used by means of example and is not meant to be limiting. Other biasing means can be used, such as an elastic material, a band around the two arms, a stopper that prevents full rotation of the first arm 208, etc.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A tool for use with a movable work piece having at least one fastener, the tool comprising:

an elongate handle;

a first arm having a distal end with an aperture configured to engage the fastener to prevent the fastener from rotating when a rotational force is exerted on the fastener, the first arm movably connected to the elongate handle; and a second arm extending from the elongate handle, the second arm spaced apart from the first arm and comprising a side surface configured to contact a portion of the movable work piece to prevent the work piece from movement, wherein:

the first arm is movably connected to the handle proximate the second arm;

the second arm further comprises a shoe portion movably connected to and at least partially covering the side surface of the second arm, the shoe portion having a surface configured to grip the work piece; and the shoe portion comprises a main portion movably connected to the second arm on a side opposite the first arm, and a side surface extending in an L-shape from an edge of the main portion, the side surface conforming to a shape of a surface of the work piece.

2. The tool of claim 1, wherein the fastener has a first axis about which it rotates and the movable work piece has a second axis about which it rotates, the first arm configured to prevent rotation of the fastener about the first axis when a rotational force is being asserted on an opposite end of the fastener, while the second arm prevents rotation of the work piece about the second axis with exertion of force on the elongate handle.

3. The tool of claim 1, wherein the second arm is an end portion of the elongate handle.

4. The tool of claim 1, wherein the shoe portion is at least partially coated with a flexible material.

5. The tool of claim 1, wherein the shoe portion is made of a rubber material.

6. The tool of claim 1, further comprising means for biasing the first arm toward the second arm.

7. The tool of claim 1, wherein the elongate handle has a contoured gripping end opposite the second arm.

8. The tool of claim 1, wherein the handle has a padded gripping end opposite the second arm.

9. The tool of claim 1, wherein the second arm extends from the elongate handle at an angle of less than ninety degrees.

10. The tool of claim 1, further comprising one or more additional first arms each configured to be interchangeable with the first arm, each of the additional first arms having a distal end configured to engage a different sized or shaped fastener.

11. The tool of claim 1, further comprising one or more additional shoe portions each configured to be interchangeable with the shoe portion, each of the additional shoe portions having a surface contoured to conform to different sized or shaped work pieces.

12. A tool for use with a movable work piece having at least one fastener, wherein the tool is used to prevent movement during loosening, tightening, or testing the fastener, the tool comprising:

an elongated main portion having a handle end configured to be gripped by a user and a work piece end configured to contact a portion of the work piece; and a first arm having a distal end with an aperture configured to engage the fastener, the first arm movably connected to the elongated main portion at a location closer to the work piece end, wherein:

the fastener has a first axis about which it rotates and the movable work piece has a second axis about which it rotates parallel to the first axis, the first arm configured to prevent rotation of the fastener about the first axis while the work piece end of the elongated main portion prevents rotation of the work piece about the second axis when a force is exerted on the handle end;

the elongated main portion comprises a shoe portion movably connected to and at least partially covering the work piece end, the shoe portion having a surface configured to contact the work piece, wherein the shoe portion comprises a main portion movably connected to the work piece end on a side of the elongated main portion opposite the first arm, and a side surface extending in an L-shape from an edge of the main body, the side surface conforming to a contour of a surface of the work piece.

13. The tool of claim 12, wherein the work piece end of the elongated main portion extends from the elongated main portion at an angle of less than ninety degrees.

* * * * *